United States Patent [19]

Elsdoerfer

[11] Patent Number: 4,729,192

[45] Date of Patent: Mar. 8, 1988

[54] MACHINING APPARATUS AND WORKPIECE HOLDING ASSEMBLY THEREFOR

[76] Inventor: Waldmar J. Elsdoerfer, 235 Love La., Warwick, R.I. 02886

[21] Appl. No.: 902,181

[22] Filed: Aug. 29, 1986

[51] Int. Cl.[4] ..... B24B 49/00

[52] U.S. Cl. ..... 51/165.71; 51/217 A; 51/240 A; 51/216 ND; 409/224

[58] Field of Search ..... 409/224; 51/218 R, 218 A, 51/217 R, 217 A, 165 TP, 165.71, 216 ND, 92 R, 240 A

[56] References Cited

U.S. PATENT DOCUMENTS

| | | | |
|---|---|---|---|
| Re. 28,766 | 4/1976 | Villano | 51/165 TP |
| 110,671 | 1/1871 | Neeb | 51/240 A |
| 310,861 | 1/1885 | Hyde et al. | 51/218 A |
| 2,397,086 | 3/1946 | Brady | 409/224 |
| 2,430,969 | 11/1947 | Young | 51/217 A |
| 3,998,127 | 12/1976 | Rameu | 409/224 |
| 4,369,958 | 1/1983 | Maynard | 409/224 |
| 4,416,570 | 11/1983 | Argenbright | 409/224 |
| 4,512,380 | 4/1985 | Schmidt | 409/224 |
| 4,629,378 | 12/1986 | Parsons | 409/224 |

FOREIGN PATENT DOCUMENTS

| | | | |
|---|---|---|---|
| 2242193 | 3/1975 | France | 409/224 |

*Primary Examiner*—Harold D. Whitehead

*Attorney, Agent, or Firm*—Salter & Michaelson

[57] ABSTRACT

A workpiece holding assembly is operable in combination with a machining apparatus, such as a grinding or milling machine, for presenting a workpiece to a cutting tool of the machining apparatus in various different angular positions in order to adapt the machining apparatus for producing undercut areas, such as dovetail-shaped slots, in the workpiece. The workpiece holding assembly includes a base which is mountable on a machining apparatus, a gimble which is rotatably mounted on the base, a mounting assembly for securing a workpiece on the gimble and a drive assembly for automatically rotating the gimble to tilt the workpiece. The workpiece holding assembly is preferably utilized in combination with a machining apparatus of a type having a computerized numerical control, and it is preferably adapted to be interconnected with the computerized control for automatically controlling the rotational movement of the gimble.

20 Claims, 10 Drawing Figures

MACHINING APPARATUS AND WORKPIECE HOLDING ASSEMBLY THEREFOR

BACKGROUND AND SUMMARY OF THE INVENTION

The instant invention relates to the machine tool art and more particularly to a machining apparatus comprising an improved workpiece holding assembly for holding and positioning a workpiece during a machining operation and to the improved workpiece holding assembly per se.

Machining apparatus such as precision surface and profile grinding machines, milling machines and other surface cutting machines have been well known in the machine tool industry for many years. In this connection, a typical conventional machining apparatus of this general type includes a chuck for holding a workpiece during a machining operation, a cutting tool which is engageable with the work piece for performing a machining operation thereon, and means for effecting relative movement between the cutting tool and the workpiece during the machining operation in order to generate a desired surface configuration in the workpiece. Generally, the means for effecting relative movement between a cutting tool and a workpiece in a machining apparatus of this type is operative for effecting relative movement in each of three mutually perpendicular directions during a machining operation in order to produce a desired surface configuration in the workpiece. In addition, in some cases a machining apparatus of this type may further include a computerized numerical control for controlling the means for effecting relative movement between the workpiece and the cutting tool in each of the three directions in order to enable the machining apparatus to automatically generate a desired configuration in a workpiece with a high degree of accuracy and precision. Precision surface and profile grinding machines, such as the Jung JF 520 CNC and the Jung JF 625 CNC machines, are exemplary of automated machining apparatus of this general type and are currently available from K Jung GmbH, Jahnstrasse 80, Postfach 640, D-7320 Göppingen, West Germany. It will be understood, however, that a variety of other manufacturers also currently produce machining apparatus of this general type.

While machining apparatus of the above described general type have been found to be effective for precisely forming workpieces into various predetermined configurations during machining operations, they have generally been found to be ineffective for producing certain types of undercut surface configurations in workpieces. For example, machining apparatus of the above described types have generally been ineffective for producing undercut areas, such as dovetail-shaped slots, in workpieces. In this connection, heretofore it has generally been possible to adapt machining apparatus of the above described type to produce undercut areas in workpieces by utilizing manually adjustable sine chucks for securing workpieces during machining operations. However, these devices have only been manually adjustable for tilting workpieces, and they have been tedious and time consuming to operate. The only alternative to utilizing sine chucks for generating undercut areas in workpieces has been to utilize projection profile grinding apparatus comprising manually tiltable grinding wheels. However, these devices have also only been manually adjustable, and therefore they have had the same basic disadvantages as the machining apparatus which have included sine chucks. In addition, it has generally been necessary to manually adjust both projection profile grinding machines and machines having sine chucks for each individual change in the angular configuration of an undercut area. Hence, the procedures which have heretofore been required for forming undercut areas in workpieces have been extremely time consuming and tedious. Further, the potential for error has been relatively high in these procedures.

The instant invention effectively overcomes the problem of producing unusual surface configurations, such as undercut areas including dovetail-shaped slots, in workpieces with machining apparatus of the above described type. Specifically, the instant invention provides an improved workpiece holding assembly for a machining apparatus which is operable for securing and positioning a workpiece in a machining apparatus so that it can be presented to the cutting tool of the apparatus in various different angular positions. More specifically, the instant invention relates to an automatically tiltable workpiece holding assembly for a machining apparatus of the above described type and to the workpiece holding assembly as it is used in combination with a machining apparatus. The workpiece holding assembly generally comprises a base which is securable on a machining apparatus, an elongated gimble having a longitudinally extending tilt axis and mounted on the base so that it is rotatable about the tilt axis, means for automatically rotating the gimble about its tilt axis, and means for sensing the rotated position of the gimble with respect to its tilt axis. The base of the workpiece holding assembly is constructed so that when it is secured on a machining apparatus the tilt axis of the gimble extends in substantially parallel relation to one of the three mutually perpendicular directions of movement of the machining apparatus. Although the workpiece holding assembly can be effectively utilized with non-computerized machining apparatus, it is preferably utilized with a machining apparatus having a computerized numerical control. Hence, preferably both the means for automatically rotating the gimble and the means for sensing the rotated position of the gimble are adapted to be interconnected with a computerized numerical control of a computerized machining apparatus for controlling the means for automatically rotating the gimble and the workpiece during a machining operation. In any event, when the workpiece holding assembly is installed in a machining apparatus of the above described type, regardless of whether or not the apparatus has a computer control, it adds a new dimension of relative movement between the workpiece and the cutting tool of the machining apparatus to enable the cutting tool to produce unusual surface configurations in the workpiece, such as undercut areas and slots.

In the preferred embodiment of the workpiece holding assembly of the instant invention, the means for rotating the gimble in the base comprises first and second worm gears on the gimble and first and second worm shafts which are rotatably mounted in the base. When the workpiece holding assembly is embodied in this manner, the first worm gear is operable for rotating the first worm shaft, whereas the second worm gear is operable for rotating the second worm shaft. Further, the first worm gear and the first worm shaft are constructed so that they are of opposite rotations from the second worm gear and the second worm shaft, and the first and second worm shafts are connected so that they rotate together but in opposite directions. Further, the worm shafts are adjusted so that when they are rotated to rotate the gimble, the first and second worm shafts simultaneously engage oppositely facing teeth of their respective worm gears to substantially prevent backlash movement in the gears which rotate the gimble. Further, the gimble is preferably supported in the base adjacent opposite longitudinal ends of the gimble, and the worm gears are preferably disposed in closely adjacent relation in a substantially central portion in the longitudinal extent of the gimble. The means for securing a workpiece on the gimble is preferably operable for securing the workpiece so that it is also positioned in the central portion of the gimble and in closely adjacent relation to the worm gears. As a result of these features, the workpiece holding assembly of the instant invention is operable for reorienting a workpiece with respect to a cutting tool in a highly accurate manner in order to produce precisely machined surface configurations in the work piece. In this connection, because the first and second worm gears are of opposite rotations and because the worm shafts engage oppositely facing teeth of the first and second worm gears, the looseness or backlash movement which would otherwise be inherent in a device of this type is substantially eliminated. Further, since the first and second worm gears are mounted on the gimble in closely adjacent relation to each other in a central portion of the gimble, the possibility of slightly deforming the gimble as a result of applying opposite torques thereto with the worm gears is essentially eliminated. Hence, it is possible to adjustably control the rotated position of a workpiece with a substantially higher degree of accuracy than was possible with the heretofore available machining apparatus and workpiece holding assemblies.

In the preferred application of the workpiece holding assembly of the subject invention, it is installed in a precision surface grinding machine of a type having a computerized numerical control and a rotating V-formed grinding wheel type cutting tool. The grinding machine is preferably further of a type wherein the first and second movement means are operable for moving the workpiece holding assembly in substantially perpendicular first and second directions, and wherein the third movement means is operable for moving the grinding wheel in a third direction which is mutually perpendicular to the first and second directions. The computerized numerical control of the apparatus may be either a point-to-point numerical control or a continuous-path numerical control, but in either case it is preferably operable for coordinating the rotational movement of the gimble in the workpiece holding assembly with the movement of the first, second and third movement means for presenting various portions of a workpiece to the grinding wheel in various different orientations. In this connection, it has been found that when the workpiece holding assembly of the subject invention is utilized in combination with a machining apparatus of this type, the machining apparatus can be effectively utilized for producing unusual surface configurations in workpieces, including undercuts such as dovetail slots, with extremely high degrees of precision. Further, the machining apparatus can be utilized for machining workpieces so that unusual surface configurations can be generated at substantially increased production rates.

Devices representing the closest prior art to the subjct invention of which the applicant is aware are disclosed in the U.S. patents to Mason U.S. Pat. No. 3,533,191; Hahn et al U.S. Pat. No. 3,634,976; Tokunaga et al U.S. Pat. No. 3,942,287; Verega U.S. Pat. No. 4,274,231; Enomoto et al U.S. Pat. No. 4,294,045; Oppelt et al U.S. Pat. No. 4,439,951; and Fletcher, Jr., et al U.S. Pat. No. 4,550,532. However, since none of these patents teach or suggest an effective device for automatically tilting a workpiece in the manner of the workpiece holding assembly of the subject invention, they are believed to be of only general interest.

Accordingly, it is a primary object of the instant invention to provide an automatically tiltable workpiece holding assembly for a machining apparatus.

Another object of the instant invention is to provide a machining apparatus which can be utilized for forming workpieces having undercut surface configurations with high degrees of accuracy at relatively high production rates.

Another object of the instant invention is to provide a tiltable workpiece holding assembly which is automatically tiltable through the use of a pair of worm gear assemblies having oppositely rotating worm shafts.

An even further object of the instant invention is to provide a tiltable workpiece holding assembly comprising a rotatable gimble and a pair of worm gear assemblies having oppositely rotating worm shafts wherein the worm gear assemblies are positioned in substantially central locations with respect to the longitudinal extent of the gimble to prevent twisting deformation in the gimble.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
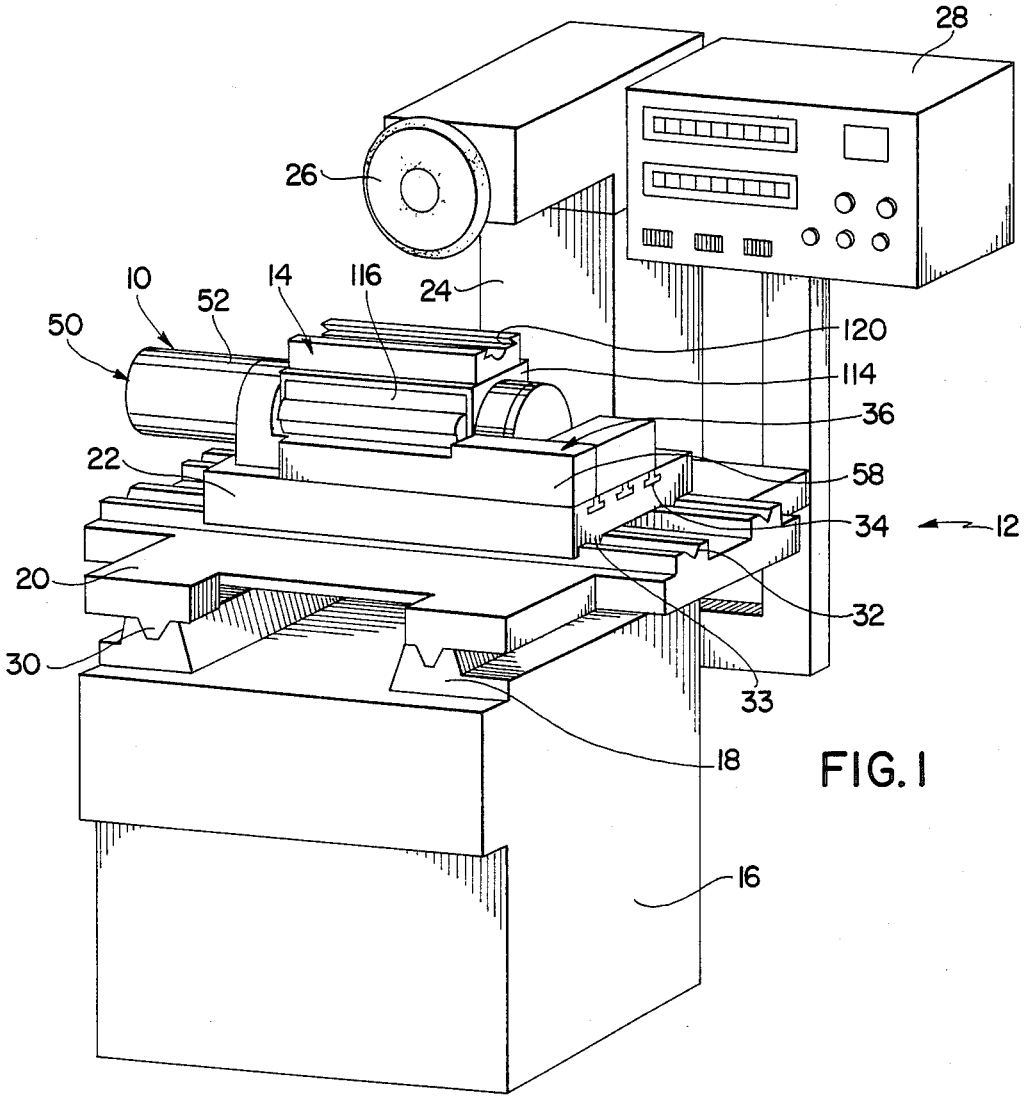
FIG. 1 is a perspective view of the machining apparatus of the instant invention.

Referring now to the drawings, the workpiece holding assembly of the instant invention is illustrated and generally indicated at 10 in FIGS. 1, 4, 5, 9 and 10, and the machining apparatus of the instant invention which includes the workpiece holding assembly 10 is illustrated and generally indicated at 10 in FIG. 1. The workpiece holding assembly 10 is operable for securing and positioning a workpiece generally indicated at 14 on the machining apparatus 12 during a machining operation in order to form a predetermined surface configuration in the workpiece 14, as will hereinafter be more fully set forth.

The machining apparatus 12 as herein embodied comprises a computerized surface grinding machine of the type currently manufactured by K Jung GmbH, Jahnstrasse 80, Postfach 640, D-7320 Göppingen, West Germany, as a JF 520 CNC A or B model profile grinding machine, although it will be understood that the workpiece holding assembly 10 can alternatively be utilized in combination with various other types of computerized and noncomputerized surface or profile grinding machines as well as with other types of machining apparatus, such as milling machines. The machining apparatus 12 comprises a machine base 16 having female ways 18 formed thereon, a cross table 20, a longitudinal table 22, a vertical column 24 which extends upwardly from the machine base 16, a V-formed wheel 26 mounted on the column 24 adjacent the upper end thereof, and a computerized numerical control 28 which is supported on the machine base 16 adjacent the column 24. The cross table 20 is slidably mounted on the machine base 16 with male cross ways 30, and means (not shown) is provided for automatically moving the cross table 20 with respect to the machine base 16 on the cross ways 18 and 30. Similarly, the longitudinal table 22 is mounted on the cross table 20 with female and male longitudinal ways 32 and 33, respectively, and means (not shown) is provided for automatically moving the longitudinal table 22 with respect to the cross table 20 in the cross ways 32 and 33. A plurality of longitudinally extending T-slots 34 are provided on the upper side of the longitudinal table 22, and the workpiece holding assembly 10 is mounted on the longitudinal table 22 with bolts (not shown) which engage the table 22 in the T-slots 34. The V-formed wheel 26 is mounted for rotation about an axis which is parallel to the cross ways 18 and 30 and perpendicular to the longitudinal ways 32 and 33, it comprises a conventional V-formed grinding wheel, such as a vitrified, diamond, or borazon wheel, having a gradually tapered outer edge which is engageable with a workpiece for generating a predetermined surface configuration therein, and it is driven by a drive motor (not shown). The column 24 is operative for vertically repositioning the V-formed wheel 26 with respect to the workpiece holding assembly 10, and hence, the relative positions between the V-formed wheel 26 and the workpiece holding assembly 10 can be adjusted along three mutually perpendicular axes by adjusting the positions of the cross table 20, the longitudinal table 22, and the column 24. The movements of the cross table 20, the longitudinal table 22 and the column 24 are automatically controlled through the computer numerical control 28, and hence it is possible to automatically control the position of the workpiece 14 with respect to the V-formed wheel 26 in each of the three mutually perpendicular directions. In this connection, during normal operation of the apparatus 12, the longitudinal table is moved to cause the V-formed wheel 26 to cut a path on the workpiece 14; and when the workpiece 14 has been moved past the V-formed wheel 26, the cross table 20 and/or the column 24 are moved to reposition the workpiece 14 with respect to the V-shaped wheel 26 before the V-formed wheel 26 again contacts the workpiece 14. The computerized numerical control 28 preferably comprises a conventional control of the type currently used on many surface and profile grinding machines, and it may be either adapted for continuous-path or point-to-point grinding operations, depending on the particular application. For example, a Jung-Andron FPK9 continuous-path controller or a General Electric 2000 series continuous-path controller can be effectively utilized for the controller 28 in order to carry out continuous path grinding operations. A variety of conventional point-to-point controllers, for example, a Siemens Sinumerik Primo SG controller, can also be used in the apparatus 10 for carrying out point-to-point grinding operations.

Referring now to FIGS. 4 through 10, the workpiece holding assembly 10 is more clearly illustrated. The workpiece holding assembly 10 comprises a base generally indicated at 36, a gimble generally indicated at 38, first and second worm gears 40 and 42, respectively, first and second worm shaft assemblies 44 and 46, respectively, a drive motor assembly generally indicated at 48, a sensor assembly generally indicated at 50 which is mounted in a sensor housing 52, and a chuck or workpiece securing assembly generally indicated at 54. The gimble 38 is of elongated configuration, and it is rotatably mounted on the base 36, and, in the embodiment herein set forth, the worm gears 40 and 42 are integrally formed on the underside of the gimble 38. The worm shaft assemblies 44 and 46 are rotatably mounted in the lower portion of the base 36 in substantially transverse relation to the gimble 38 so that they are engageable with the worm gears 40 and 42, respectively, for rotating the gimble 38. The drive motor assembly 48 is operatively connected to the worm shafts 44 and 46 so that it is actuatable for automatically effecting rotation of the gimble 38 about its longitudinal axis in the base 36, and the sensing assembly 50 is adapted for sensing the rotated position of the gimble 38 in the base 36.

The base 36 is constructed to provide a suitable mounting structure for the motor assembly 48, the gimble 38, the worm shafts 44 and 46, and the sensing assembly 50, and it preferably has a substantially flat bottom surface to enable it to be effectively received and secured on the longitudinal table 22. It will be understood, however, that other embodiments of the machining apparatus of the instant invention wherein the base 36 is integrally formed in a machine table are also contemplated. The base 36 as herein embodied is constructed so that it includes a drive belt housing 56 having a cover plate 58, first and second bearing seats 60 and 62, respectively, which are located adjacent opposite longitudinal ends of the base 36, a pair of sensor mounting plates 64, and first and second bearing locks 66 and 68, respectively, which are operative for securing bearings in the bearing seats 60 and 62, respectively.

The gimble 38 comprises an elongated shaft having a substantially planar table or surface 70 on one side thereof and having reduced cylindrical end shaft portions 72 and 74 at opposite longitudinal ends thereof. The end shaft portions 72 and 74 are received in bearings 76 and 78 which are assembled in the bearing seats 60 and 62, respectively, and secured therein with the locks 66 and 68, respectively. Accordingly, the gimble 36 is journalled in the base 36 so that it is rotatable about its longitudinally extending tilt axis. The table or surface 70 is oriented so that it is disposed in parallel relation to the axis of the gimble 38, as illustrated most clearly in FIG. 5.

The worm gears 40 and 42 are integrally formed with the gimble 38 on the opposite side thereof from the surface 70 and in a substantially central area in the longitudinal extent of the gimble 38. More specifically, the worm gears 40 and 42 are integrally formed on a common leg 80 which extends integrally from the central portion of the gimble 38, and the gears 40 and 42 are oriented and constructed for effecting rotation of the gimble 38 about the longitudinally extending tilt axis thereof. The first and second worm gears 40 and 42, respectively, are, however, of opposite rotational configurations so that they are adapted to be utilized in combination with worm shafts of opposite rotations.

The worm shaft assemblies 44 and 46 are journalled for rotation in the base 36 beneath the worm gears 40 and 42, respectively. The worm shaft assemblies 44 and 46 include helical worm shafts 82 and 84, respectively, and first and second transmission gears 86 and 88, respectively, which are mounted on the ends of the shafts 82 and 84. The worm shafts 82 and 84 are mounted in bearings 90 in the housing 36 so that the transmission gears 86 and 88 intermesh with each other and so that the worm shafts 82 and 84 intermesh with the worm gears 40 and 42, respectively. In this connection, the worm shafts 82 and 84 are of opposite rotational configurations, although they are obviously of the same rotational configurations as their respective worm gears 40 and 42. However, since the worm shaft assemblies 44 and 46 are interconnected through the transmission gears 86 and 88, the worm shafts 82 and 84 always rotate together but in opposite directions so that they cooperate for rotating the gimble 38 through the worm gears 40 and 42 whenever they are rotated.

Figure 6:
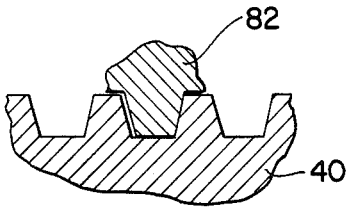
FIGS. 6 and 7 are sectional views illustrating the operation of the worm shafts and worm gears of the workpiece holding assembly.
Figure 7:
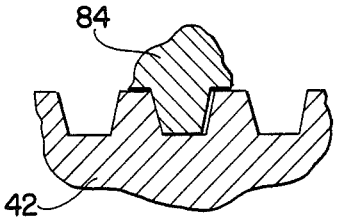
Figure 8:
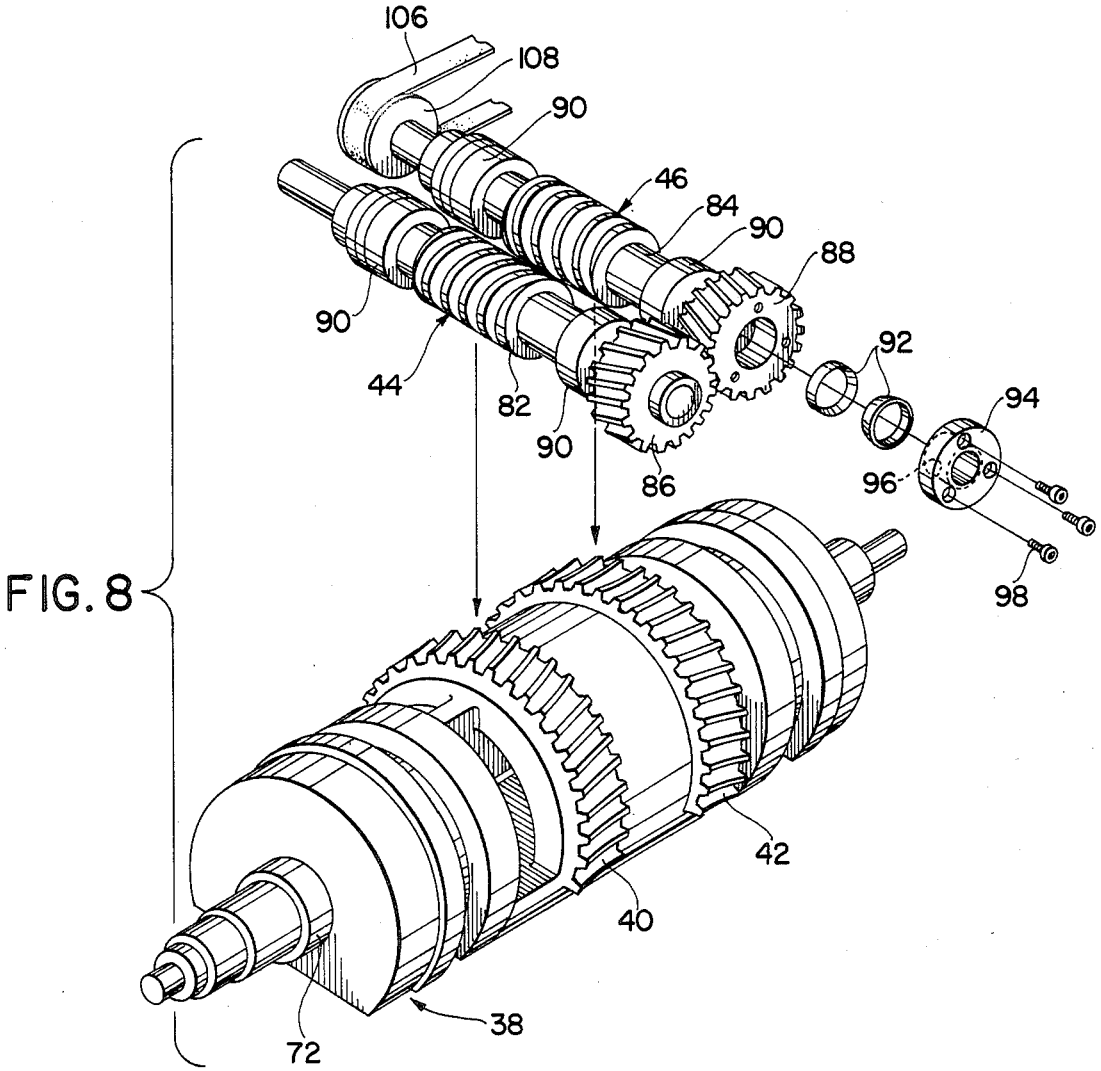
FIG. 8 is an inverted exploded perspective view of the gimble, the worm shafts and the worm gears of the workpiece holding assembly.
Figure 9:
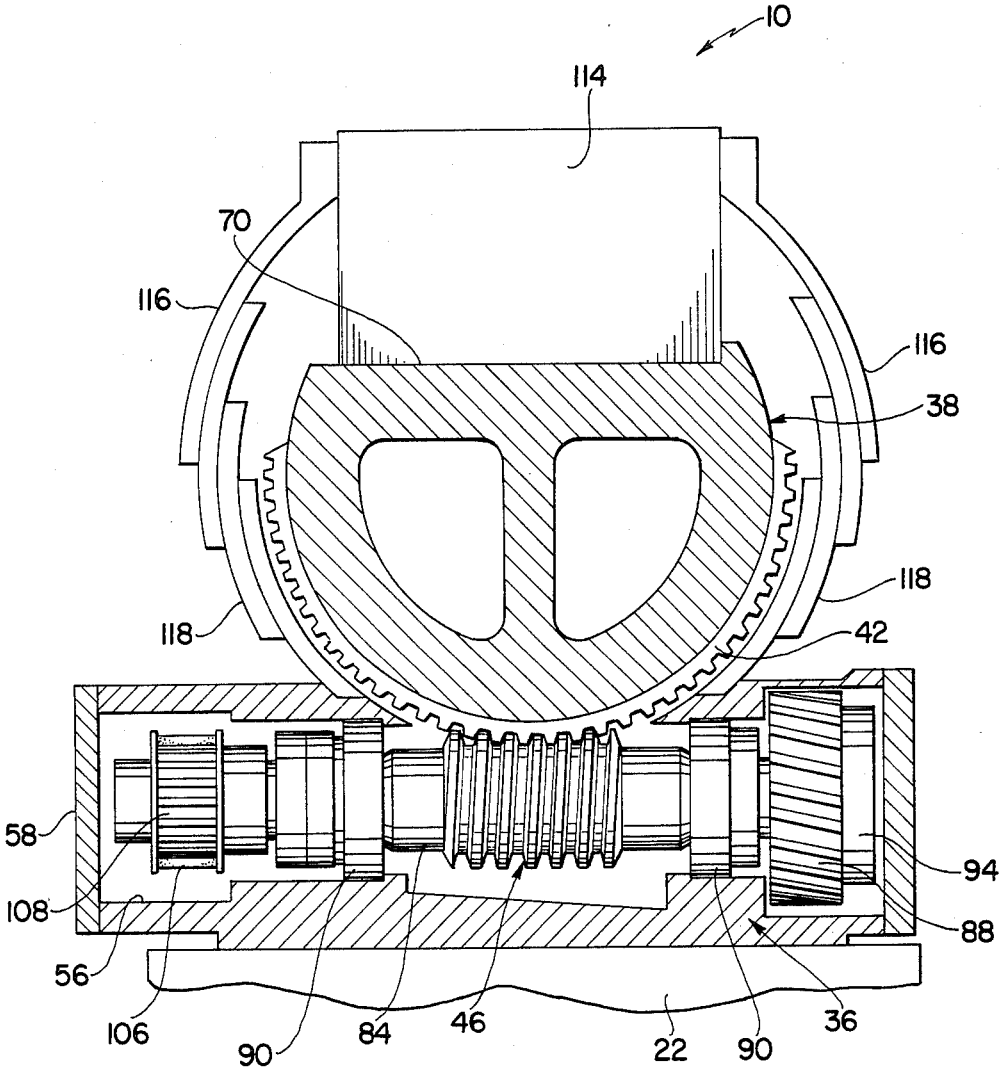
FIG. 9 is a sectional view taken along line 9—9 in FIG. 4.

Referring to FIGS. 6 through 8, the manner in which the worm shaft assemblies 44 and 46 cooperate for rotating the gimble 38 is more clearly illustrated. In this connection, as will be seen from FIG. 8, while the transmission gear 86 is nonadjustably secured on the worm shaft 82, the transmission gear 88 is adjustably secured on the worm shaft 84, and it includes an adjustment assembly comprising a pair of conically tapered rings 92 and a clamping disc 94 having a tubular projection 96 thereon. The clamping disc 94 is adapted to be secured on the transmission gear 88 with screws 98 so that the rings 92 are longitudinally compressed to secure the gear 88 in a fixed position on the shaft 84. However, by loosening the screws 98, the rotated position of the transmission gear 88 with respect to the shaft 84 can be adjusted. As a result, it is possible to adjust the worm shafts 82 and 86 so that they cooperate with the worm gears 40 and 42, respectively, for substantially eliminating looseness which would result in backlash in the movement of the gimble 38. More specifically, by adjusting the rotated position of the transmission gear 88 on the shaft 84, it is possible to adjust the worm shafts 82 and 84 so that they engage oppositely facing surfaces of the teeth on their respective worm gears 40 and 42 in the manner illustrated in FIGS. 6 and 7. As a result, it is possible to substantially eliminate the looseness or play which is inherent in a single worm gear assembly so that the movement of the gimble 38 can be controlled with a greater degree of precision. Further, since the worm gears 40 and 42 are disposed in closely adjacent relation in a central portion of the gimble 38, the gimble is not normally deformed to any significant degree as a result of opposite torques which are applied thereto with the worm shafts 82 and 84 and the worm gears 40 and 42.

The drive assembly 48 comprises a drive motor 100 which is mounted in the base 36 and has a drive shaft 102. A drive pulley 104 is mounted on the shaft 102, and it communicates through a drive belt 106 with a drive pulley 108 which is mounted on the worm shaft 84. The drive pulleys 104 and 108 and the drive belt 106 are enclosed in the housing 56 with the cover 58. The drive motor 100 is operative for driving the worm shaft 84 so that it drives the worm shaft 82 through the transmission gears 86 and 88 and so that the worm shafts 82 and 84 cooperate for rotating the gimble 38 in the manner hereinabove set forth.

Figure 10:
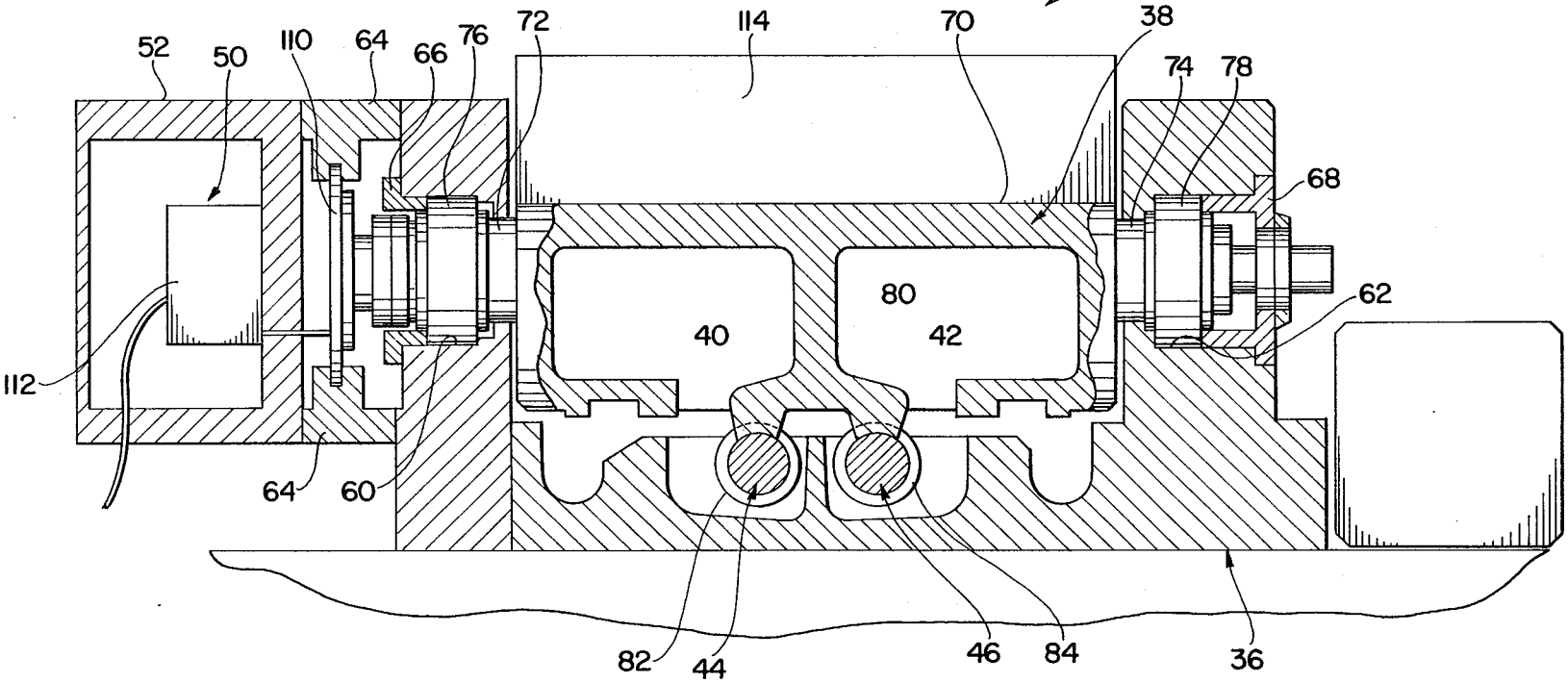
FIG. 10 is a sectional view taken along line 10—10 in FIG. 4.

The sensing assembly 50 is most clearly illustrated in FIG. 10, and it comprises a circular, disc-shaped transducer 110 which is secured in the workpiece holding assembly 10 adjacent the terminal end of the shaft 72 with the mounting plates 64. The transducer 110 preferably comprises a conventional transducer, such as a rotary transducer of the type manufactured by Farrand Controls Division of Farrand Industries, Inc., and marketed as a rotary Inductosyn transducer and it is operative for sensing the rotated position of the gimble 38 in the base 36. The sensing assembly 50 further comprises a preamplifier 112 which is electrically connected to the transducer 110 for receiving electrical signals therefrom and for amplifying the signals before they are sent to the controller 28. The preamplifier 112 is also of conventional construction, and it is mounted in the housing 52.

The chuck or workpiece securing assembly 54 preferably comprises a conventional magnetic chuck 114 of the type currently used in machining apparatus, such as surface grinding machines and milling machines, for holding workpieces during machining operations. The chuck 114 is constructed so that it is receivable and securable on the surface 70 of the gimble 38 and actuatable for receiving and rigidly securing a workpiece with respect to the gimble 38. Secured to opposite sides of the chuck 114 are covers 116 which include telescoping plates 118, as illustrated most clearly in FIG. 9. As illustrated, the plates 118 are slidable with respect to each other in telescoping relation to provide covers for the sides of the gimble 38 and the worm gears 40 and 42 while nevertheless allowing the gimble 38 and the worm gears 40 and 42 to be rotated in the base 36 in the manner hereinabove set forth. In this connection, other embodiments of the holding assembly wherein the interior of the housing area defined by the plates is pressurized with air and wherein air bearings are provided between the plates 118 to enable them to easily slide on one another are also contemplated.

Figure 2:
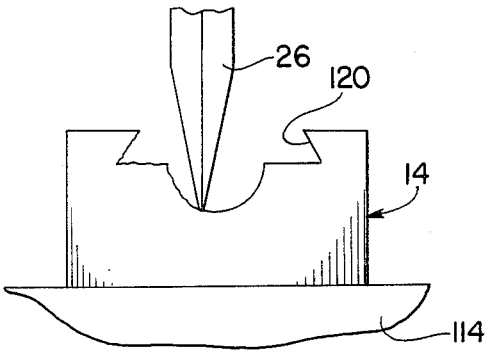
FIGS. 2 and 3 are enlarged views illustrating the operation of the machining apparatus for generating an undercut surface configuration in a workpiece.
Figure 3:
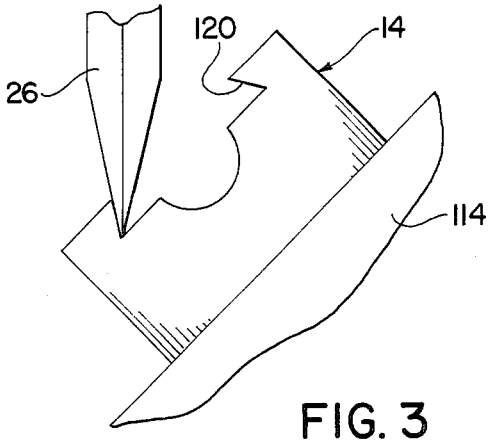
Figure 4:
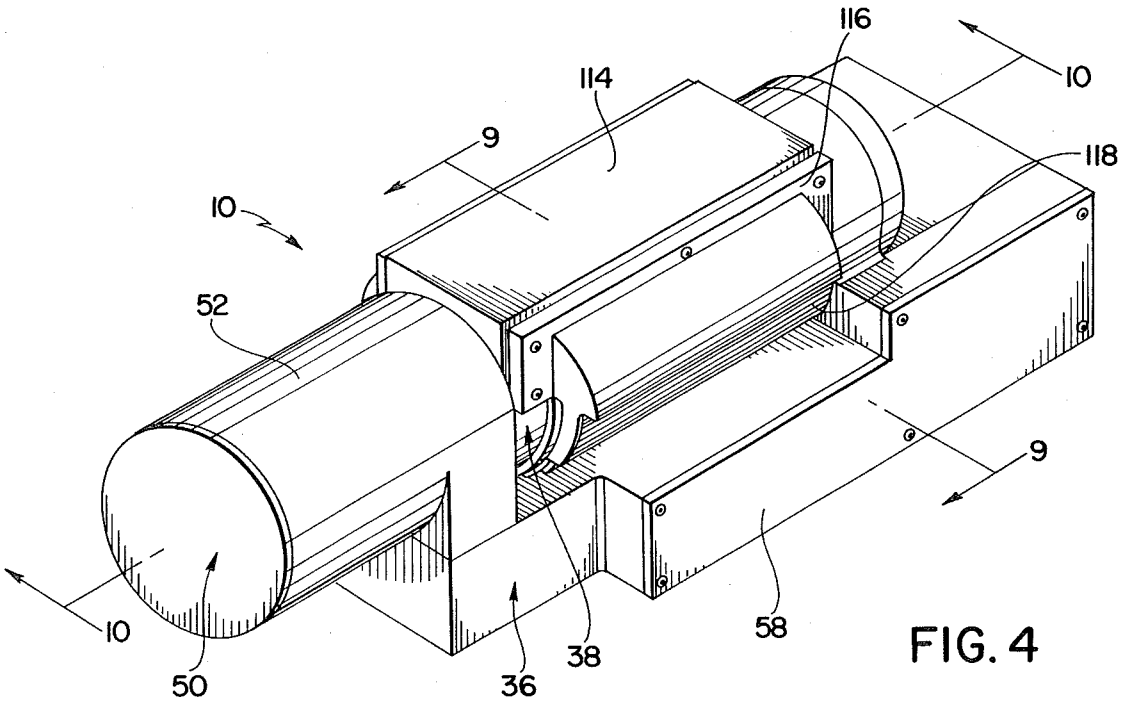
FIG. 4 is a perspective view of the workpiece holding assembly of the instant invention.
Figure 5:
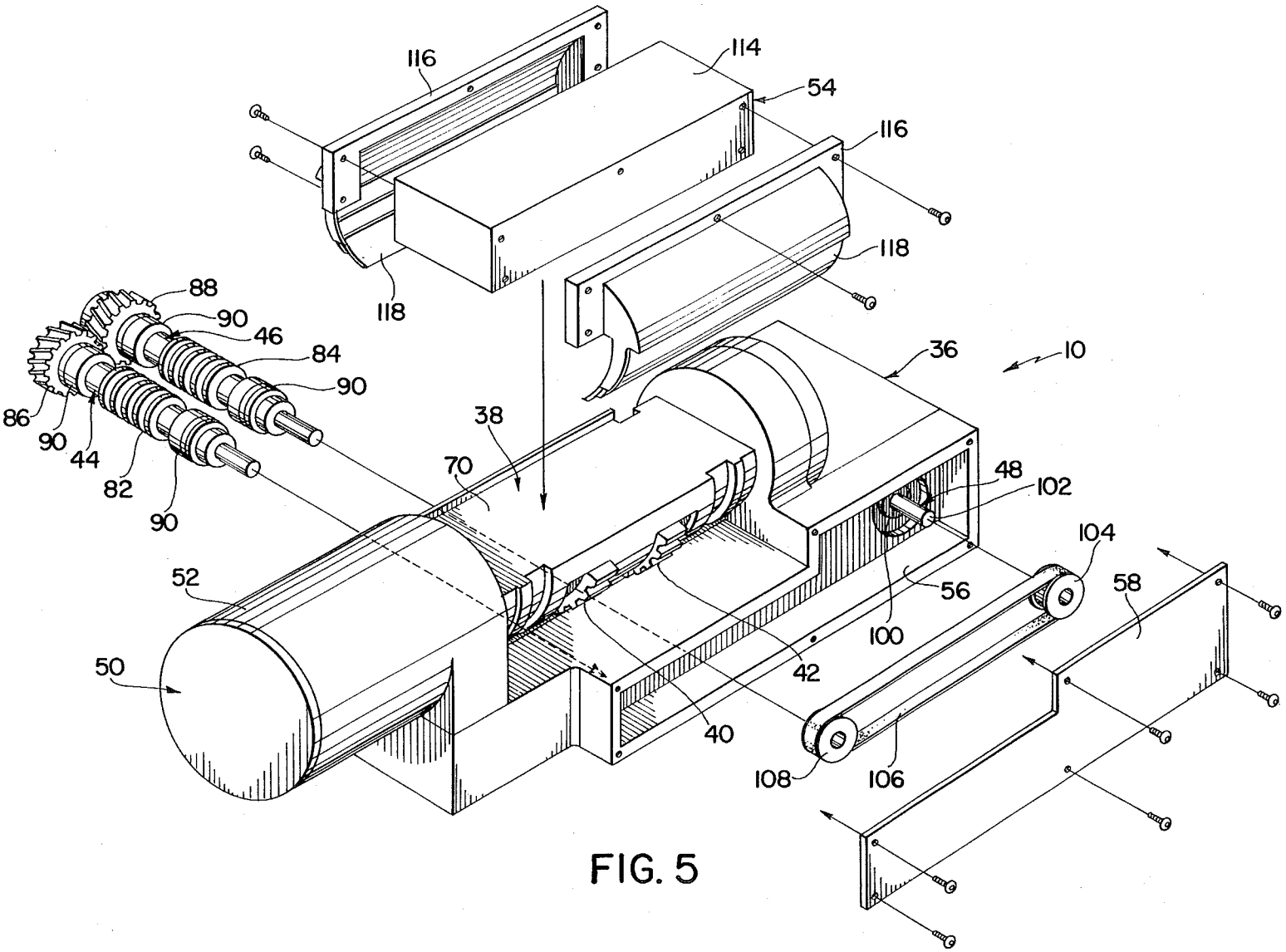
FIG. 5 is an exploded perspective view thereof.

For use and operation of the workpiece holding assembly 10, it is secured on the horizontal table 22 so that the tilt axis of the chuck 114 is perpendicular to the axis of the V-formed wheel 26, the workpiece 14 is secured on the magnetic chuck 114, and the controller 28 is programmed to carry out an appropriate machining operation with the V-formed wheel 26. In this connection, because the machining apparatus 12 is operable for reorienting the workpiece 14 in each of three mutually perpendicular directions, as well as for tilting it about an axis which extends in one of the three directions, it is possible to present the workpiece 14 to the V-formed grinding wheel 26 in a wide variety of different orientations in order to generate various different surface configurations in the workpiece 14. In fact, because the workpiece 14 can be tilted about the axis of the gimble 38, it is possible to generate undercut surface configurations in the workpiece 14. For example, as illustrated in FIGS. 2 and 3, it is possible to form undercuts such as the dovetail-shaped undercuts 120 in the workpiece 14 by tilting and otherwise moving the workpiece 14 with respect to the V-formed wheel 26. In this connection, in some instances it can be desirable to apply point-to-point cutting techniques, including creep feed, to remove the major portion of the material which must be cut from a workpiece in order to generate a desired surface configuration and to thereafter apply continuous-path cutting techniques to finish the cutting procedure so that the desired smoothness can be achieved in the surface which is generated on the workpiece. The cutting operation illustrated in FIG. 2 represents a procedure of this type wherein countinuous-path cutting is being utilized to produce a finished surface configuration in a workpiece 14 which has previously been cut utilizing point-to-point techniques. Further, it will also be understood that by altering the configuration of the V-formed wheel 26 or by using other types of cutting tools, other surface configurations can be generated in workpiece utilizing similar techniques.

It is seen, therefore, that the instant invention provides an effective an innovative improvement in the heretofore available machining apparatus, such as surface grinding machines and milling machines. Specifically, the workpiece holding assembly 10 adds a new degree of movement to a machining apparatus which enables the machining apparatus to generate new and different types of surface configurations in workpieces at relatively high production rates. The workpiece holding assembly 10 can be utilized in combination with a noncomputerized machining apparatus to provide a means for easily, quickly and effectively automatically tilting a workpiece during a machining operation. Further, the workpiece holding assembly 10 can alternatively be utilized in combination with a computerized machining apparatus for automatically controlling the tilting movement of the workpiece holding assembly so that it is coordinated with the other movements of a machining apparatus to automatically generate desired surface configurations. Further, because of the manner in which the workpiece holding assembly 10 is constructed, it is operable with a high degree of accuracy and essentially without backlash movement. Hence, the machining apparatus 12 can generate unusual surface configurations in workpieces with extremely high degrees of precision and accuracy. Accordingly, for these reasons, as well as the other reasons hereinabove set forth, it is seen that the instant invention represents a significant advancement in the machine tool art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. In a machining apparatus for performing a machining operation on a workpiece wherein the machining apparatus is of a type which includes means for holding said workpiece during said machining operation, a cutting tool which is engageable with said workpiece for performing said machining operation thereon, and first, second and third movement means for effecting relative movement between said cutting tool and said workpiece in first, second and third mutually perpendicular directions, respectively, during said machining operation, the improvement comprising said means for holding a workpiece further characterized as a workpiece holding assembly comprising a base, a gimble having a tilt axis, in one of said three directions and which is mounted on said base spaced first and second mounting means for mounting said gimble on said base so that it is rotatable about said tilt axis and so that said tilt axis extends in one of said three directions, means for securing said workpiece on said gimble, means for automatically rotating said gimble about said tilt axis, and means for sensing the rotated position of said gimble with respect to said tilt axis, said means for rotating said gimble comprising first and second worm gears rigidly mounted in closely adjacent, substantially parallel relation on said gimble between said first and second mounting means, first and second worm shafts rotatably mounted in closely adjacent, substantially parallel relation in said workpiece holding assembly, interengaging first and second transmission gears on said first and second worm shafts, respectively, directly mechanically interconnecting said first and second worm shafts for rotation together in opposite directions, said first worm shaft interengaging said first worm gear, said second worm shaft interengaging said second worm gear, said first worm gear and said first worm shaft being of opposite rotation from said second worm gear and said second worm shaft, said first and second worm shafts engaging oppositely facing teeth of said first and second worm gears, respectively, to substantially prevent backlash movement in said gimble both during and after rotation thereof in either direction about said tilt axis.

2. In the machining apparatus of claim 1, said tool further characterized as a rotating V-formed wheel, said tilt axis being substantially perpendicular to the axis of rotation of said V-formed wheel.

3. In the machining apparatus of claim 1, said first and second movement means moving said workpiece holding assembly and said workpiece, said third movement means moving said tool, said tilt axis being substantially parallel to one of said first or second directions.

4. In the machining apparatus of claim 1, said means for rotating said gimble comprising a first worm gear on said gimble and a first worm shaft rotatably mounted in said workpiece holding assembly, said first worm shaft engaging said first worm gear for rotating said gimble, and means for rotating said first worm gear.

5. In the machining apparatus of claim 1, said gimble being rotatably supported in said base adjacent opposite longitudinal ends of said gimble, said first worm gear being disposed in a substantially central position in the longitudinal extent of said gimble.

6. In the machining apparatus of claim 1, said means for rotating said gimble further comprising first and second worm gears on said gimble and first and second worm shafts rotatably mounted in said workpiece holding assembly, said first worm shaft engaging said first worm gear to effect rotation thereof, said second worm shaft engaging said second worm gear to effect rotation thereof, said first worm gear and said first worm shaft being of opposite rotation from said second worm gear and said second worm shaft, said first and second worm shafts being connected for rotation together in opposite directions and engaging oppositely facing teeth of said first and second worm gears, respectively, to substantially prevent backlash movement in said gimble.

7. In the machining apparatus of claim 6, said first and second worm gears being mounted on said gimble in closely adjacent relation.

8. In the machining apparatus of claim 1, said gimble being rotatably supported in said base adjacent longitudinally opposite ends of said gimble, said worm gears being disposed in a substantially central position in the longitudinal extent of said gimble.

9. In the machining apparatus of claim 1, said means for securing a workpiece on said gimble being disposed in closely adjacent relation to said first and second worm gears in the longitudinal extent of said gimble and being operable for securing said workpiece in closely adjacent relation to said worm gears in the longitudinal extent of said gimble.

10. In a machining apparatus for performing a machining operation on a workpiece wherein the machining apparatus is of a type which includes means for holding said workpiece during said machining operation, a cutting tool which is engageable with said workpiece for performing said machining operation thereon, first, second and third movement means for effecting relative movement between said cutting tool and said workpiece in first, second and third mutually perpendicular directions, respectively, during said machining operation, and a computerized numerical control for controlling said first, second and third movement means to control the relative positions of said tool and said workpiece in each of said three directions during said machining operation, the improvement comprising said means for holding a workpiece further characterized as a workpiece holding assembly comprising a base, a gimble having a tilt axis, spaced first and second mounting means for mounting said gimble on said base so that it is rotatable about said tilt axis and so that said tilt axis extends in one of said three directions, means for securing said workpiece on said gimble, means for automatically rotating said gimble about said tilt axis, and means for sensing the rotated position of said gimble with respect to said tilt axis, said computerized numerical control being responsive to said sensing means and controlling said means for rotating said gimble to control the rotated positions of said gimble and said workpiece during said machining operation, said means for rotating said gimble comprising first and second worm gears rigidly mounted in closely adjacent, substantially parallel relation on said gimble between said first and second mounting means, first and second worm shafts rotatably mounted in closely adjacent, substantially parallel relation in said workpiece holding assembly, interengaging first and second transmission gears on said first and second worm shafts, respectively, directly mechanically interconnecting said first and second worm shafts for rotation together in opposite directions, said first worm shaft interengaging said first worm gear, said second worm shaft interengaging said second worm gear, said first worm gear and said first worm shaft being of opposite rotation from said second worm gear and said second worm shaft, said first and second worm shafts engaging oppositely facing teeth of said first and second worm gears, respectively, to substantially prevent backlash movement in said gimble both during and after rotation thereof in either direction about said tilt axis.

11. In the machining apparatus of claim 10, said computerized numerical control further characterized as coordinating the movement of said first, second and third movement means with the movement of said gimble rotating means to present predetermined portions of said workpiece to said tool in predetermined orientations during said machining operation.

12. A workpiece holding assembly for securing and positioning a workpiece on a machining apparatus during a machining operation wherein the machining apparatus is of a type which includes a cutting tool which is engageable with said workpiece for performing said machining operation thereon when said workpiece holding assembly is mounted on said apparatus, said workpiece holding assembly comprising a base which is securable on said apparatus, a gimble having a tilt axis, spaced first and second mounting means for mounting said gimble on said base so that it is rotatable about said tilt axis, means for automatically rotating said gimble about said tilt axis, and means for sensing the rotated position of said gimble with respect to said tilt axis, said means for rotating said gimble comprising first and second worm gears rigidly mounted in closely adjacent, substantially parallel relation on said gimble between said first and second mounting means, first and second worm shafts rotatably mounted in closely adjacent, substantially parallel relation in said workpiece holding assembly, interengaging first and second transmission gears on said first and second worm shafts, respectively, directly mechanically interconnecting said first and second worm shafts for rotation together in opposite directions, said first worm shaft interengaging said first worm gear, said second worm shaft interengaging said second worm gear, said first worm gear and said first worm shaft being of opposite rotation from said second worm gear and said second worm shaft, said first and second worm shafts engaging oppositely facing teeth of said first and second worm gears, respectively, to substantially prevent backlash movement in said gimble both during and after rotation thereof in either direction about said tilt axis.

13. In the workpiece holding assembly of claim 12, said means for rotating said gimble comprising a first worm gear on said gimble and a first worm shaft rotatably mounted in said workpiece holding, said first worm shaft engaging said first worm gear for rotating said gimble, and means for rotating said first worm gear.

14. In the workpiece holding assembly of claim 14, said gimble being rotatably supported in said first and second mounting means adjacent opposite longitudinal ends of said gimble, said first and second worm gears being substantially centrally disposed in the longitudinal extent of said gimble.

15. In the workpiece holding assembly of claim 13, said means for rotating said gimble comprising first and second worm gears on said gimble and first and second worm shafts rotatably mounted in said workpiece holding assembly in longitudinally fixed relation, said first worm shaft engaging said first worm gear to effect rotation thereof, said second worm shaft engaging said second worm gear to effect rotation thereof, said first worm gear and said first worm shaft being of opposite rotation from said second worm gear and said second worm shaft, said first and second worm shafts being connected for rotation together in opposite directions and engaging oppositely facing teeth of said first and second worm gears, respectively, to substantially prevent backlash movement in said gimble.

16. In the workpiece holding assembly of claim 15, said first and second worm gears being mounted on said gimble in closely adjacent relation.

17. In the workpiece holding assembly of claim 12, the rotational position of one of said worm shafts being adjustable with respect to the rotational position of the other of said worm shafts for adjusting said worm shafts to engage oppositely facing teeth of their respective worm gears.

18. In the workpiece holding assembly of claim 12, said gimble being supported in said first and second mounting means adjacent longitudinally opposite ends of said gimble, said worm gears being substantially centrally disposed in the longitudinal extent of said gimble.

19. In the workpiece holding assembly of claim 12, said means for securing a workpiece on said gimble being in closely adjacent relation to said first and second worm gears in the longitudinal extent of said gimble and securing said workpiece in closely adjacent relation to said worm gears in the longitudinal extent of said gimble.

20. A workpiece holding assembly for securing and positioning a workpiece on a machining apparatus during a machining operation wherein the machining apparatus is of a type which includes a cutting tool which is engageable with said workpiece for performing said machining operation thereon when said workpiece holding assembly is secured on said apparatus, first, second and third movement means for effecting relative movement between said cutting tool and said workpiece in first, second and third mutually perpendicular directions, respectively, during said machining operation, and a computerized numerical control for controlling said first, second and third movement means to control the relative positions of said tool and said workpiece in each of said three directions during said machining operation, said workpiece holding assembly comprising a base which is securable on said apparatus, a gimble having a tilt axis, spaced first and second mounting means for mounting said gimble on said base so that it is rotatable about said tilt axis and so that said tilt axis extends in one of said three directions, means for automatically rotating said gimble about said tilt axis, means for sensing the rotated position of said gimble with respect to said tilt axis, said means for rotating said gimble and said sensing means being interconnectable with said computerized numerical control for controlling the rotated positions of said gimble and said workpiece during said machining operation, said means for rotating said gimble comprising first and second worm gears rigidly mounted in closely adjacent, substantially parallel relation on said gimble between said first and second mounting means, first and second worm shafts rotatably mounted in closely adjacent, substantially parallel relation in said workpiece holding assembly, interengaging first and second transmission gears on said first and second worm shafts, respectively, directly mechanically interconnecting said first and second worm shafts for rotation together in opposite directions, said first worm shaft interengaging said first worm gear, said second worm shaft interengaging said second worm gear, said first worm gear and said first worm shaft being of opposite rotation from said second worm gear and said second worm shaft, said first and second worm shafts engaging oppositely facing teeth of said first and second worm gears, respectively, to substantially prevent backlash movement in said gimble both during and after rotation thereof in either direction about said tilt axis.

* * * * *